United States Patent [19]

Thomas

[11] 4,285,673

[45] Aug. 25, 1981

[54] COLOR DEMONSTRATION DEVICE AND METHOD

[76] Inventor: Mark A. Thomas, 740 Purcell Ave., Cincinnati, Ohio 45205

[21] Appl. No.: 33,534

[22] Filed: Apr. 26, 1979

[51] Int. Cl.[3] ..... F21V 9/00

[52] U.S. Cl. ..... 434/98; 362/231

[58] Field of Search ..... 35/19 B, 28.3, 50, 55, 35/59, 60; 46/DIG. 1; 272/10; 356/407; 362/231, 234, 250, 811

[56] References Cited

U.S. PATENT DOCUMENTS

| | | | |
|---|---|---|---|
| 1,223,459 | 4/1917 | Whitney . | |
| 1,451,046 | 4/1923 | Maxwell . | |
| 1,649,689 | 11/1927 | Hasait . | |
| 2,074,704 | 3/1937 | Osborne | 35/28.3 |
| 2,121,246 | 6/1938 | Gordon | 35/50 |
| 2,169,022 | 8/1939 | Chubb . | |
| 2,530,912 | 11/1950 | Secofsky | 362/250 X |
| 2,725,230 | 11/1955 | Weintraub . | |
| 3,143,300 | 8/1964 | Way | 362/231 |
| 3,251,985 | 5/1966 | Krupnick . | |
| 3,366,786 | 1/1968 | Delano | 362/234 X |
| 3,412,485 | 11/1968 | Reigler | 35/55 |
| 3,805,049 | 4/1974 | Frank . | |
| 3,816,739 | 6/1974 | Stolov . | |
| 4,071,809 | 1/1978 | Weiss . | |
| 4,125,888 | 11/1978 | Tsuchihashi . | |
| 4,138,714 | 2/1979 | Tsuchihashi . | |

OTHER PUBLICATIONS

Cenco 1969 Educational Catalog, p. 140, "Illuminators".

Graves, Maitland, "Color Fundamentals", pp. 18, 19, 20, Oct. 1953, Sci. Lib.

Willie the Fuzzy Felt Weather Man, Playthings Mag., p. 43, Sep. 1959.

*Primary Examiner*—Harland S. Skogquist

*Attorney, Agent, or Firm*—Frost & Jacobs

[57] ABSTRACT

A color demonstration and teaching device for illustrating the reflective and absorptive characteristics of substantially flat opaque objects of various configurations and colors demountably positioned on an opaque planar screen having clearly defined red, green, blue, and yellow areas under the influence of illumination from red, green, white, blue and yellow light sources having individual continuously variable light intensity control.

10 Claims, 5 Drawing Figures

COLOR DEMONSTRATION DEVICE AND METHOD

SUMMARY OF THE INVENTION

Various types of devices and processes have been proposed for demonstrating the laws and perception of color. For example, the additive properties of color may be demonstrated by using the rudimentary device illustrated in U.S. Pat. No. 1,451,046 issued Apr. 10, 1923 to W. Maxwell, where a red and blue light are focused on a white screen to produce purple illumination. If a solid object is interposed between the screen and one of the colored light sources, a shadow of the opposite color will be produced, thus demonstrating the substractive properties of color. A more sophisticated method for producing colored shadows is illustrated in U.S. Pat. No. 4,125,888 issued Nov. 14, 1978 to Tsuchihashi, et al. using specific illuminance ratios.

U.S. Pat. No. 4,071,809 issued Jan. 31, 1978 to Weiss, et al. describes a synthesizer using the additive properties of color through the use of a plurality of different colored filters to provide corresponding primary color radiations which are combined to produce a tone having a specified color content. Similarly, transparent or translucent projection screens are utilized to combine colors such as illustrated in U.S. Pat. No. 1,649,689 issued Nov. 15, 1927 to M. Hasit and U.S. Pat. No. 3,816,739 issued June 11, 1974 to M. Stolov.

An area largely overlooked by prior art workers concerns the reflective and absorptive characteristics of colored objects under the influence of light sources of variable intensity and color. As is well known, a colored object which appears as one color under a first set of lighting conditions, may have the appearance of a completely different color under a second set of lighting conditions. Since the response of the human eye varies with wave length, the apparent color or sensation will depend on the chronmatic distribution of the light illuminating the colored object. As a result, two different colored objects which match under incandescent light (which is yellowish), for example, may not match when compared under the light from a blue sky.

The present invention provides a method and apparatus for dramatically illustrating and teaching this principal utilizing the reflective and absorptive characteristics of objects of various configurations and color under the influence of projected illumination of varying intensity and color.

In a preferred embodiment, the color demonstration and teaching device of the present invention comprises illumination means for producing directional illumination of preselected color and intensity, and a visually perceptible colored target positioned in the path of the illlumination. The illumination means includes a box-like base having one surface forming a control panel mounting a plurality of spaced rotatable light intensity controls. A vertical support member is removably affixed to and extends upwardly from the base, and pivotally supports at its upper end a substantially horizontal support bar. The support bar mounts spaced red, green, white, blue and yellow light sources. Each of the light sources comprises a substantially opaque cylindrical housing, an electric projection lamp disposed within the housing, and a color filter and focusing lens positioned between the lamp and the light output end of the housing. The lamp is movable axially within the housing for focusing the light output. In addition, the output end of the housing is constructed of a translucent material for providing a visual indication of the color and intensity of light being projected.

Each of the light sources is adjustably attached to the support bar to provide vertical and horizontal movement. The variable intensity controls mounted on the control panel may be used to individually and continuously vary the light intensity of an associated lamp between full off and full on limits.

The target means includes a substantially planar opaque screen spaced from the light sources, the surface of the screen comprising vertical contiguous red, green, yellow and blue felt strips of more or less equal width. A plurality of thin colored opaque felt objects of various shapes are positioned upon the screen surface and remain in place as a result of cohesion between the felt surfaces, while being readily mountable and demountable on the screen.

Using the apparatus described hereinabove, the absorptive and reflective properties of the colored shapes positioned on the screen can be investigated and demonstrated by illuminating the screen with selected individual colors or combination of colors of predetermined intensity projected from the illumination means, as will be described in more detail by specific examples hereinafter. Furthermore, by moving particular shapes having desired colors to overlie areas of the screen of a particular color, other properties such as primary colors, complimentary colors, addition, subtraction, the ability of colors to reflect and absorb light, and vibration may be dramatically demonstrated. Finally, the appearance of a particular artistic design of asthetic value formed by selected shapes and background may be altered by illuminating the design with light comprising particular colors or combinations of colors of selected intensity.

DETAILED DESCRIPTION

Figure 1:
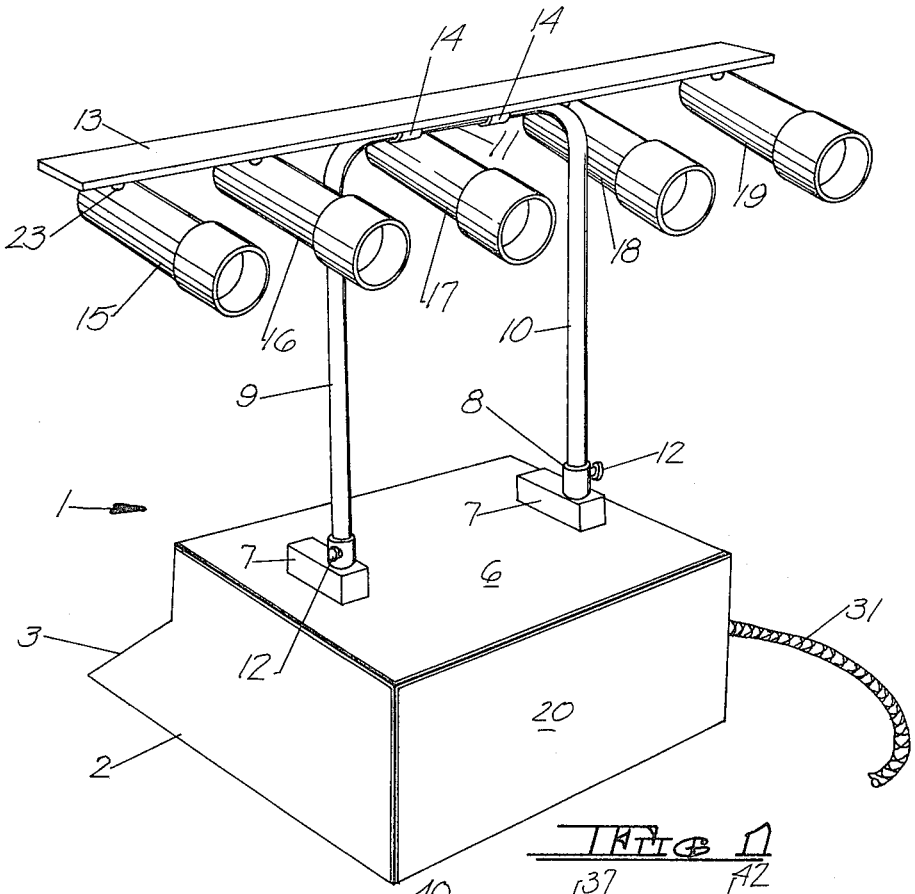
FIG. 1 is a front perspective view of the illumination source of the present invention, partially cutaway.

FIG. 1 illustrates a front perspective view of the illumination source, shown generally at 1, of the color teaching and demonstration device of the present invention. Illumination source 1 comprises a box-like base member 2 having a substantially planar lower surface for resting base member 2 on a suitable support such as a table or the like (not shown). The lower portion of the rearmost end of base member 2 comprises a sloping control panel 3 containing five spaced intensity controls, one of which is shown at 4, rotatable between a full off and a full on position. Suitable calibration indices 5 may be provided for the intensity controls, as desired. As will be explained in more detail hereinafter, each intensity control 4 is associated with an individual light source for continuously controlling the intensity of the light output from the light source.

The upper surface 6 of base member 2 is provided with a pair of spaced mounting blocks 7 rigidly affixed to the upper surface of base member 2. Each mounting block contains a vertically oriented cylindrical cup 8. A U-shaped vertical support member 9 includes a pair of spaced tubular vertical downwardly depending legs 10 joined at their upper ends by a tubular horizontal bar 11, with the lower ends of legs 10 inserted into cups 8. A set screw 12 threadedly engaged in the vertical side of each cup 8 may be tightened against the outer surface of legs 10 to hold vertical support member 9 securely in place.

A substantially horizontal elongated plate-like light support bar 13 extends substantially parallel to horizontal member 11 and is pivotally secured thereto at approximately its midpoint by means of a pair of spaced pivotal connections, one of which is shown at 14. This arrangement permits light support bar 13 to be folded flat against legs 10 of vertical support member 9 to facilitate storage and transport of illumination source 1.

Figure 4:
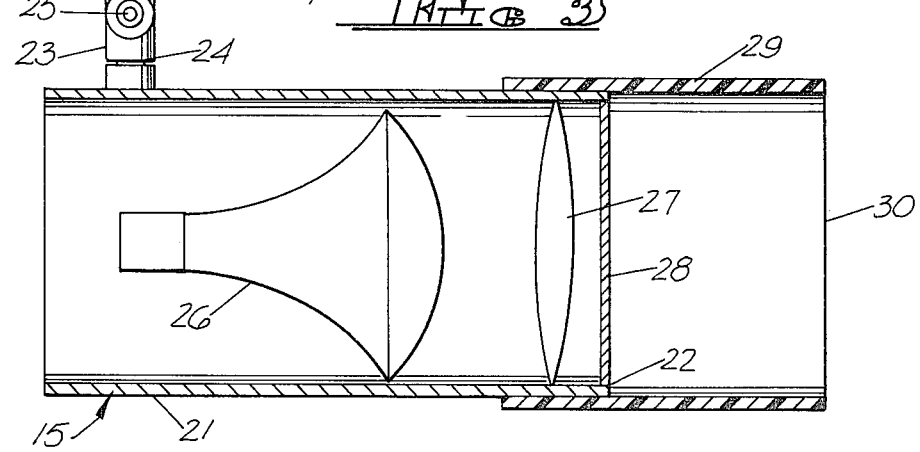
FIG. 4 is a side elevation view, partially in cross section, of one of the light sources of the present invention.

A plurality of cylindrical light sources 15–19 are suspended from the lower surface of light support bar 13 in spaced apart relationship, with the light output end of each light source facing the forward end 20 of base member 2. Since the construction of each light source is substantially the same, light source 15 will be described in detail as illustrative as shown in more detail in FIG. 4. Fundamentally, light source 15 comprises a tube-like cylindrical housing 21 having at least one end 22 open and designated the light output end of the light source. In general, it is preferred that housing 21 be constructed of an opaque material such as metal, plastic or the like. Housing 21 is secured to light support bar 13 near its rear end by means of adjustment post 23. Post 23 contains a lower swivel connection 24 permitting light source 15 to pivot about a vertical axis for adjustment in the horizontal plane, and an upper pivot 25 permitting light source 15 to pivot about a horizontal axis for adjustment in the vertical plane.

An electric lamp or spotlight 26 is disposed within housing 21. In general, the inside diameter of housing 21 will be dimensioned to provide a relatively snug fit with lamp 26 to hold the lamp firmly in place. This arrangement also permits lamp 26 to be moved axially within the housing for focusing the light output as required. Further focusing may be accomplished by means of a converging lens 27 positioned within housing 21 between lamp 26 and output end 22.

In order to provide colored light from each light source, a color filter 28 having the desired spectral passband may be provided at the output end 22 of housing 21. Filter 28 may be constructed of cellulose acetate or other suitable material. For purposes of an exemplary showing, and as will be described in more detail hereinafter, light sources 15 and 16 have been provided with green and blue color filters 28, respectively, while light sources 18 and 19 have been provided with yellow and red color filters 28, respectively. No filter or a colorless filter is used for light source 17 in order to provide white light.

The output end 22 of housing 21 terminates in a cylindrical translucent sleeve 29 slipped over and secured to the output end of housing 21. The terminal end 30 of sleeve 29 is open for projecting a beam of light produced by lamp 26. The translucent characteristic of sleeve 29 permits a visual assessment to be made of the color and intensity of the light being projected by a particular light source.

Each of intensity controls 4 is connected to a respective one of lamps 26 by wiring means not shown to control the intensity of lamp 26 from a full off to a full on condition. Electric power is provided to the lamps and intensity controls by means of power cord 31.

Figure 2:
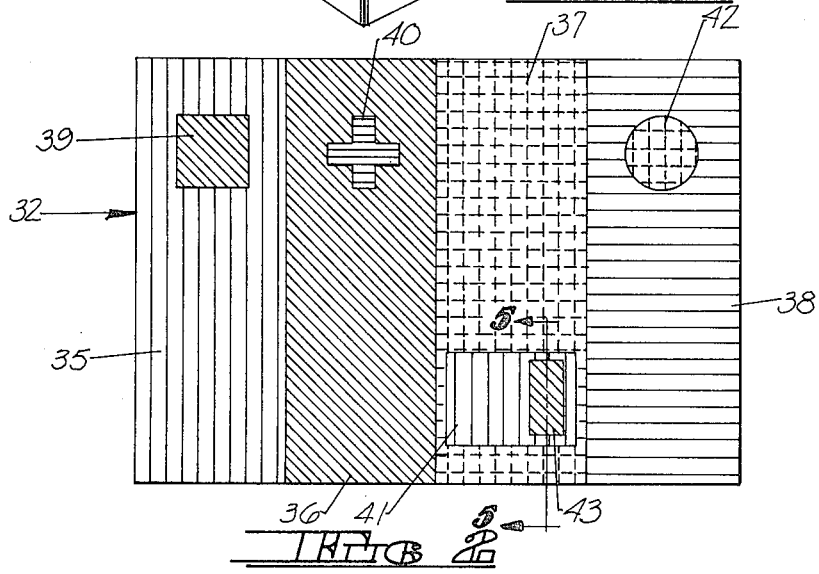
FIG. 2 is a front elevation view of the target screen with selected colored shapes positioned on the screen.
Figure 3:
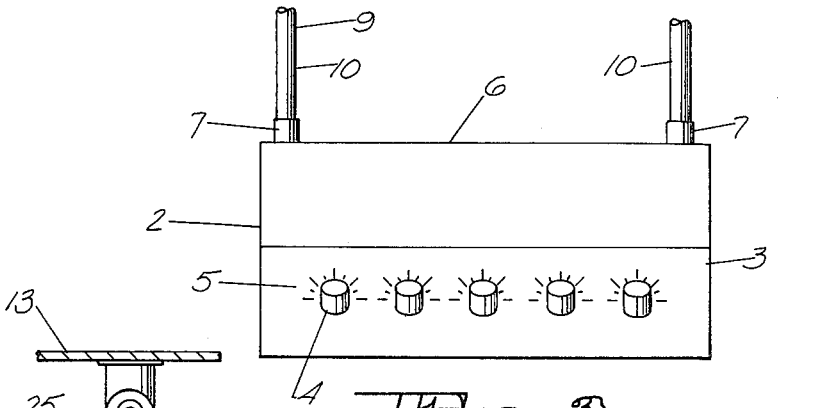
FIG. 3 is a fragmentary front elevation view of the base member of the illumination source illustrated in FIG. 1.
Figure 5:
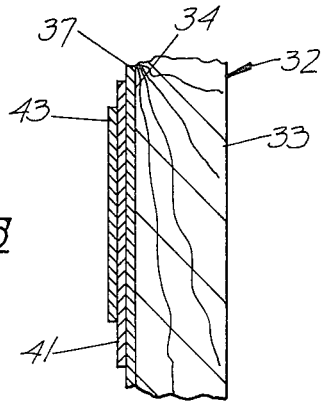
FIG. 5 is a fragmentary cross sectional view taken along section line 5—5 of FIG. 2.

The target screen, shown generally at 32 in FIG. 2 and FIG. 5, comprises a thin rectangular wooden platform 3 configured to be mounted in a substantially vertical position. One surface 34 of platform 33 is covered with four contiguous vertical felt strips 35–38. As illustrated in FIG. 2, strips 35–38 are colored red, green, yellow and blue, respectively, corresponding to the colors of light sources 15, 16, 18 and 19. Although for purposes of an exemplary showing, strips 35–38 have been described and illustrated as individual members, platform 33 may be covered with a continuous felt covering having the appropriately colored areas.

A plurality of thin opaque felt strip shapes 39-42 colored green, blue, red and yellow, respectively, are positioned on the surface of target screen 32. It will be understood that other colors may be chosen for the colored shapes, as desired, in order to demonstrated particular color combinations. The use of a felt material for shapes 39–42 permit the shapes to adhere cohesively to the surface of colored strips 35-38 without additional attachment means. As used herein, a cohesive material is one having the ability to stick to itself. It will be understood that this construction permits the shapes to be readily mountable and demountable on selected portions of target screen 32. Furthermore, additional colored opaque felt shapes, such as that illustrated at 43, may be positioned upon another shape, such as 41, with the cohesive properties of the felt material holding the overlying shape in place.

In operation, target screen 32 is positioned so as to be intercepted by colored or white light emitted by illumination source 1. A particular combination of shapes 39–43 is chosen and positioned on desired colored areas of the target screen. The intensity of selected light sources 15–19 is adjusted by means of intensity controls 4 in order to provide the desired illumination color and intensity for demonstrating particular absorption or reflection characteristics of colored areas 35–38, or shapes 39–43, as will be described in more detail by specific examples hereinafter.

The following examples are illustrative of the method of the present invention for demonstrating and teaching the reflective and absorptive characteristics of colored objects under the influence of illumination of variable intensity and color.

EXAMPLE 1

With the configuration shown in FIG. 2, and the target screen 32 illuminated by red, blue and green light, the colored shapes will appear in their normal colors since the red, blue and green illuminating light constitutes the primary colors of white light. In other words, the colored shapes reflect their inherent hue and absorb all other colors.

EXAMPLE 2

Another arrangement for demonstrating the reflective and absorptive characteristics of colored objects uses shapes having colors of brown, purple, pink, ochre, white, yellow, red, black, green and blue. Under the influence of red light alone, brown and purple will appear similar. Likewise, pink, ochre, white, yellow and red will appear similar demonstrating the similar ability of these colors to reflect red light. Finally, the black, green and blue shapes will appear similar, demonstrating the similar ability of these colors to absorb red light. Consequently, the blue shape 40 positioned on green area 36 will appear to be the same color, causing the colored shape 40 to blend into the background 36.

EXAMPLE 3

Complimentary colors such as red and green appear to vibrate when placed side-by-side as shown in FIG. 2 for green shape 39 overlying red area 35. This effect is intensified under the influence of corresponding colored light. Since it has been found that the specific color and intensity of the illumination is critical in producing the apparent vibratory effect, the present invention readily permits accurate adjustments in the intensity level and mixture of colors to facilitate demonstration of the effect. It has also been found that when changing from one colored light to another, multi-colored shapes positioned on the target screen 32 appear to move or change shape.

EXAMPLE 4

Using suitably colored background areas and colored shapes, a particular artistic design of asthetic value may be formed and illuminated with light comprising particular colors or combinations of colors of selected intensity to produce an overall effect. When the illuminating colors or intensity are changed, the overall appearance of the design also changes as a result of vibration or blending of colors having similar reflective and absorptive characteristics to produce a different asthetically pleasing design, without changing the color, position or shape of the target screen or objects positioned thereon.

It will be understood that various changes in the details, materials, steps and arrangements of parts, which have been herein described and illustrated in order to explain the nature of the invention, may be made by those skilled in the art within the principal and scope of the invention as expressed in the appended claims. For example, while for purposes of an exemplary showing, the illumination source has been described and illustrated as containing green, blue, white, yellow and red light sources, it will be understood that the device may be constructed with only green, blue and red sources, since yellow light can be produced by a combination of red and green, and existing room illumination may be substituted for the white light source. Likewise, the color, shape or position of strips 35–38 on target screen 32, as well as the color, position and shape of objects 39–43, may be varied as required for particular demonstrations.

The embodiments of the invention in which an exclusive property or privilege is claimed are as follows:

1. A color demonstration and teaching device for illustrating the reflective and absorptive characteristics of objects of various configurations and colors under the influence of illumination of varying intensity and color, said device comprising illumination means for producing directional illumination of preselected color and intensity and visually perceptable target means positioned in the path of said illumination, said illumination means comprising:

a. a base member having means for providing stable support of said illumination means on a planar surface;

b. means attached to said base member for supporting a plurality of light sources;

c. red, green and blue light sources for projecting red, green and blue light, respectively, spaced along said support means, each of said light sources including means for projecting a substantially unidirectional stable beam of monochromatic light on the target means;

d. means for independently selecting the light intensity output of each of said light sources to permit illumination of said target means in a multiplicity of selectable color permutations.

2. The demonstration and teaching device according to claim 1 wherein said illumination means includes a white light source attached to said support means.

3. The demonstration and teaching device according to claim 1 wherein said illumination means includes a yellow light source attached to said support means and said screen includes a clearly defined yellow area.

4. The demonstration and teaching device according to claim 1 wherein each of said light sources includes an electric lamp disposed within a substantially opaque tube-like housing, the light output end of said housing being formed of a translucent material for providing a visual indication of the color and intensity of the light being projected.

5. The demonstration and teaching device according to claim 4 wherein said light output from said light source may be focused on said screen by moving said lamp axially within said housing.

6. The demonstration and teaching device according to claim 1 wherein said red, green and blue areas comprises contiguous red, green and blue strips.

7. The demonstration and teaching device according to claim 1 wherein said screen and said object are constructed from a cohesive material.

8. The demonstration and teaching device according to claim 7 wherein said cohesive material comprises felt.

9. The demonstration and teaching device according to claim 1 including at least two of said objects of different colors positioned in overlying relationship on said screen, said objects including means for readily mounting and demounting said objects to each other.

10. A color demonstration and teaching device for illustrating the reflective and absorptive characteristics of objects of various configurations and colors under the influence of illumination of varying intensity and color, said device comprising:

a. a box-like base member having one surface forming a control panel;

b. a vertical support member removably affixed to and extending upwardly from said base member;

c. a substantially horizontal light support bar pivotally secured at approximately its midpoint to the upper end of said vertical support member;

d. red, green white, blue and yellow light sources spaced along said support bar, each of said light sources comprising a substantially opaque tube-like housing, an electric lamp disposed within said housing, and a color filter positioned between said lamp and the light output end of said housing, said lamp being movable axially within said housing for focusing the light output, said output end of said housing being translucent for providing a visual indication of the color and intensity of the light being projected, each of said light sources including means for projecting a substantially unidirectional stable beam of monochromatic light;

e. adjustment means attaching each of said housings to said support bar for providing vertical and horizontal adjustment of said projected light;

f. a variable intensity control associated with each of said light sources and located on said control panel for independently selecting the light intensity output of the associated lamp to form a multiplicity of selectable color permutations;

g. a substantially planar opaque screen spaced from said light sources, the surface of said screen comprising vertical contiguous red, green, yellow and blue felt strips; and h. at least one thin colored opaque felt shape readily mountable and demountable on said screen surface, whereby said objects and said screen may be selectively illuminated with light having preselected color and intensity.

* * * * *